United States Patent [19]

Wahle et al.

[11] 4,368,742

[45] Jan. 18, 1983

[54] APPARATUS FOR REPLENISHING THE SUPPLIES OF FILTER ROD SECTIONS IN THE MAGAZINES OF FILTER TIPPING MACHINES

[75] Inventors: Gunter Wahle, Reinbek; Alois Kasparek, Hamburg, both of Fed. Rep. of Germany

[73] Assignee: Hauni-Werke Korber & Co. KG., Hamburg, Fed. Rep. of Germany

[21] Appl. No.: 228,966

[22] Filed: Jan. 27, 1981

[30] Foreign Application Priority Data

Feb. 2, 1980 [DE] Fed. Rep. of Germany ..... 3003912

[51] Int. Cl.[3] ..... A24C 5/47; A24C 5/00

[52] U.S. Cl. ..... 131/88; 131/94; 131/909; 131/282

[58] Field of Search ..... 131/88, 94, 95, 280, 131/282, 283, 909; 141/198; 221/175, 176, 278; 406/70, 155

[56] References Cited

U.S. PATENT DOCUMENTS 3,608,972 9/1971 Rudszinat ..... 406/70

3,789,744 2/1974 Wahle ..... 131/94

*Primary Examiner*—V. Millin

*Attorney, Agent, or Firm*—Kontler, Grimes & Battersby

[57] ABSTRACT

The magazine of each of an entire battery of filter tipping machines receives filter rod sections by way of two discrete pneumatic conveyors whose inlets receive filter rod sections from discrete sources by way of pneumatic propelling units and whose outlets admit files of axially moving filter rod sections into discrete receiving units having devices for converting the files into rows and for forcibly feeding the rows into spaced-apart portions of the respective magazines below the upper surfaces of the supplies of filter rod sections in such magazines. Each propelling unit can be started or arrested independently of the associated propelling unit, and each receiving unit can feed filter rod sections at less than maximum capacity and/or intermittently.

15 Claims, 8 Drawing Figures

2A
2B
2C
2D
2E
3A
3B
3C
3D
3E
4A
4B
4C
4D
4E
A
B
C
D
E

APPARATUS FOR REPLENISHING THE SUPPLIES OF FILTER ROD SECTIONS IN THE MAGAZINES OF FILTER TIPPING MACHINES

BACKGROUND OF THE INVENTION

The present invention relates to apparatus for replenishing the supplies of filter rod sections in the magazines of machines which process filter rod sections, especially in the magazines of filter tipping machines wherein filter rod sections are assembled with rod-like tobacco-containing articles to form filter tipped cigars, cigarillos or cigarettes.

It is already known to deliver filter rod sections into the magazine of a filter tipping machine from a remote location by resorting to a pneumatic conveyor whose inlet receives filter rod sections from a suitable sender, which advances the filter rod sections toward the filter tipping machine by moving the filter rod sections axially, and which discharges filter rod sections seriatim into a suitable receiving unit serving to convert the axially advancing filter rod sections into a row wherein the filter rod sections move sideways on their way into the magazine. It is also known to provide or combine the receiving unit with a system of belts or other types of conveyors which forcibly introduce the filter rod sections into the magazine, preferably below the normal level of the upper surface of the supply of filter rod sections in the magazine. Reference may be had, for example, to commonly owned U.S. Pat. No. Re. 28,383 granted Apr. 8, 1975 to Rudszinat for an apparatus which converts a file of axially advancing filter rod sections into a row wherein the filter rod sections move sideways. The patented apparatus has a pair of endless belt conveyors or the like for forcibly introducing the filter rod sections of the thus obtained row into the magazine below the upper surface of the supply of filter rod sections in the magazine.

Apparatus for pneumatically transporting rod-shaped articles or tobacco shreds from a remote location of the locale of further processing are becoming increasingly popular in the tobacco processing industry. For example, it is known to discharge the output of a filter rod making machine into a suitable reservoir system wherein the filter rod sections (e.g., sections of six or eight times unit length) remain for a certain interval of time to ensure satisfactory curing of the filamentary filter material as well as complete or adequate setting of adhesive which is used to seal the wrapping material for the filaments (provided that the filter rod sections are of the type having discrete wrappers). The outlet of the reservoir system supplies filter rod sections to a pneumatic sender which propels the sections into several discrete pneumatic conveyors each serving to satisfy the requirements of a discrete filter tipping machine. Such automation of the transport of filter rod sections between the maker and the filter tipping machines renders it possible to install an entire battery of filter tipping machines at a location which is remote from the makers.

A drawback of presently known apparatus of the above outlined character is that the pneumatic senders, the pneumatic conveyors and/or the units which deliver filter rod sections from the outlets of the pneumatic conveyors to the magazines of the corresponding filter tipping or other filter processing machines require cleaning, inspection and/or repair at regular or irregular intervals. Malfunctioning of one such unit intermediate the reservoir system and the filter tipping machines is likely to necessitate stoppage of the corresponding processing machine for extended periods of time with attendant pronounced losses in output, especially in modern cigarette makers which can turn out many thousands of cigarettes per minute. As a rule, the delivery of filter rod sections from a filter rod maker or form a reservoir system of the filter tipping or other filter processing machines must be interrupted as a result of deformation or destruction (e.g., quashing) of filter rod sections in the pneumatic conveyors, in the pneumatic senders upstream of the pneumatic conveyors or in the units which transfer filter rod sections from the pneumatic conveyors into the magazines of the associated processing machines. Another common cause of frequent or reasonably frequent stoppages is the need for cleaning of the pneumatic conveyors and/or of the pneumatic senders which deliver filter rod sections into the pneumatic conveyors. Even though disturbances or malfunctions can develop in each and every part of an apparatus which delivers filter rod sections from a maker to one or more processing machines. they are most likely to occur in the pneumatic sender or senders as well as in the receiving units, i.e., immediately upstream and immediately downstream of the pneumatic conveyors. The magazine of each processing machine serves as a reservoir for temporary storage of a certain supply of filter rod sections so as to ensure that the processing machine need not be arrested in response to each and every (even very short-lasting) interruption of delivery of fresh filter rod sections to its magazine. In order to prevent accidental misalignment of filter rod sections which enter the magazine, or to reduce the likelihood of such misalignment, the receiving unit which transfers filter rod sections into the magazine proper, or the feeding means which immediately follows the receiving unit, is provided with the aforementioned belts or like means for forcibly introducing filter rod sections into the magazine below the normal level of the upper surface of the supply of filter rod sections in the magazine. Thus, each next-following filter rod section pushes the preceding section or sections into the interior of the magazine wherein the incoming sections displace the previously introduced sections with attendant raising of the upper surface of the accumulated supply. Such mode of introduction can also lead to malfunctions, especially since a single receiving unit must satisfy the needs of an entire processing machine, such as a modern high-speed filter tipping machine. This will be readily appreciated since the magazine should be relatively large so as to be capable of satisfying the requirements of a high-speed processing machine for a reasonable period of time in the event of a malfunction in the delivering or replenishing apparatus. This means that the incoming filter rod sections must displace a substantial pile of preveiously introduced sections with attendant likelihood of deformation of and/or other damage to the filter rod sections. Each damaged filter rod section can entail the making of as many as eight defective filter cigarettes which must be detected by a suitable testing unit and segregated from satisfactory filter cigarettes.

Thus, wherein the provision of a large magazine ensures that the processing machine can operate for a relatively long period of time in the absence of admission of fresh filter rod sections, the presently known replenishing apparatus for delivery of fresh filter rod sections into such magazines are not entirely satisfactory because the admission of filter rod sections at a single locus of a magazine is likely to result in damage to the incoming as well as to the previously admitted filter rod sections with attendant increase in the percentage of defective final products and losses in filter material as well as tobacco shreds. The output of a filter tipping machine cannot be reduced at will so as to allow for the utilization of relatively small magazines because this would render the machine uneconomical or much less economical and would prevent direct coupling of such machine with high-speed machines which process finished filter cigarettes, e.g., with machines which pack the cigarettes, which thereupon introduce cigarette packs into cartons, and which introduce cartons into boxes or other types of receptacles.

OBJECTS AND SUMMARY OF THE INVENTION

An object of the invention is to provide a novel and improved apparatus for replenishing the supply of filter rod sections in one or more machines which process filter rod sections, especially in filter tipping machines which turn out filter cigarettes.

Another object of the invention is to provide an apparatus of the just outlined character which is less likely to damage or deface the filter rod sections during transport from one or more sources to the magazine or magazines of one or more processing machines.

A further object of the invention is to provide an apparatus which can satisfy the needs of high-speed processing machines in spite of the fact that the likelihood of damage to the transported commodities is much less pronounced than in heretofore known apparatus.

An additional object of the invention is to provide novel and improved means for introducing filter rod sections into the magazine of a filter tipping or other processing machine in such a way that fluctuations of the supply in the magazine can be held to a minimum, even in the event of pronounced variations in the rate of delivery of sections to the magazine.

Another object of the invention is to provide an apparatus which is less prone to malfunction than heretofore known apparatus, which can automatically pinpoint the location of a defect or malfunction, which requires a minimum of supervision, and which can be installed in existing plants as a superior substitute for heretofore known apparatus serving to replenish the supplies of filter rod sections in filter tipping or other processing machines.

A further object of the invention is to provide the apparatus with novel and improved means for delivering filter rod sections at a desired rate including the delivery of relatively large or relatively small quantities of filter rod sections per unit of time.

Another object of the invention is to provide an apparatus which can utilize many heretofore known units or components and whose space requirements are surprisingly small in spite of its ability to satisfy the needs of one or more (including a large or very large number of) filter tipping or other filter material processing machines.

An ancillary object of the invention is to provide novel and improved control means for use in an apparatus of the above outlined character in order to ensure automatic starting or termination of delivery of filter rod sections into the magazine or magazines of one or more processing machines.

Another object of the invention is to provide the apparatus with novel and improved means for effecting simultaneous delivery of filter rod sections to an entire battery of processing machines, especially filter tipping machines which turn out filter cigarettes of unit length or multiple unit length.

The invention is embodied in an apparatus for replenishing the supply of filter rod sections in the magazine of a processing machine, such as a filter tipping machine, wherein the magazine is normally filled to a predetermined level. The apparatus comprises at least one source of filter rod sections, discrete first and second pneumatic conveyors which serve for axial transport of filter rod sections and whose inlets and outlets are respectively adjacent to the source and to the magazine, discrete first and second propelling units which include means (e.g., rotary fluted drums) for delivering filter rod sections from the source into the inlets of the respective (first and second) pneumatic conveyors, and discrete first and second receiving units each of which has means for accepting filter rod sections from the outlet of the respective pneumatic conveyor, deflecting means for converting the thus accepted filter rod sections into rows wherein the sections advance sideways (i.e., in a direction transversely of their respective axes), and means for feeding the rows of filter rod sections from the respective deflecting means into spaced-apart portions of the magazine in regions below the predetermined level of the upper surface of the supply of filter rod sections in the magazine. Each of the feeding means preferably includes means for forcibly introducing the rows of filter rod sections into the magazine. It is presently preferred to introduce the two rows of filter rod sections from two opposite sides of the magazine so that the sections which are introduced by one of the two feeding means do not interfere with the sections which are introduced by the other feeding means or vice versa.

The feeding means may comprise pairs of endless flexible elements in the form of belts having portions of stretches which are spaced apart from each other by distances at most equaling the diameter of a filter rod section. The deflecting means then comprise wedges or like elements for delivery of successive filter rod sections which are to form the rows between the aforementioned portions of the respective pair of flexible elements for forcible introduction into the magazine.

Each of the propelling units is preferably constructed and assembled in such a way that it can be started or arrested independently of the other propelling unit. This renders it possible to rapidly fill the magazine by simultaneously operating both propelling units, to gradually fill the magazine or to gradually replenish the supply of filter rod sections by intentionally operating only one of the pneumatic conveyors at a time, or to operate only one of the pneumatic conveyors when the other pneumatic conveyor or the appurtenant equipment is damaged or requires inspection or cleaning. This ensures that the operation of the processing machine need not be interrupted; if one of the pneumatic conveyors cannot deliver filter rod sections at the rate at which the machine processes the sections, the output of the machine is simply reduced for an interval of time which is needed to complete the repair work on the other half of the apparatus.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
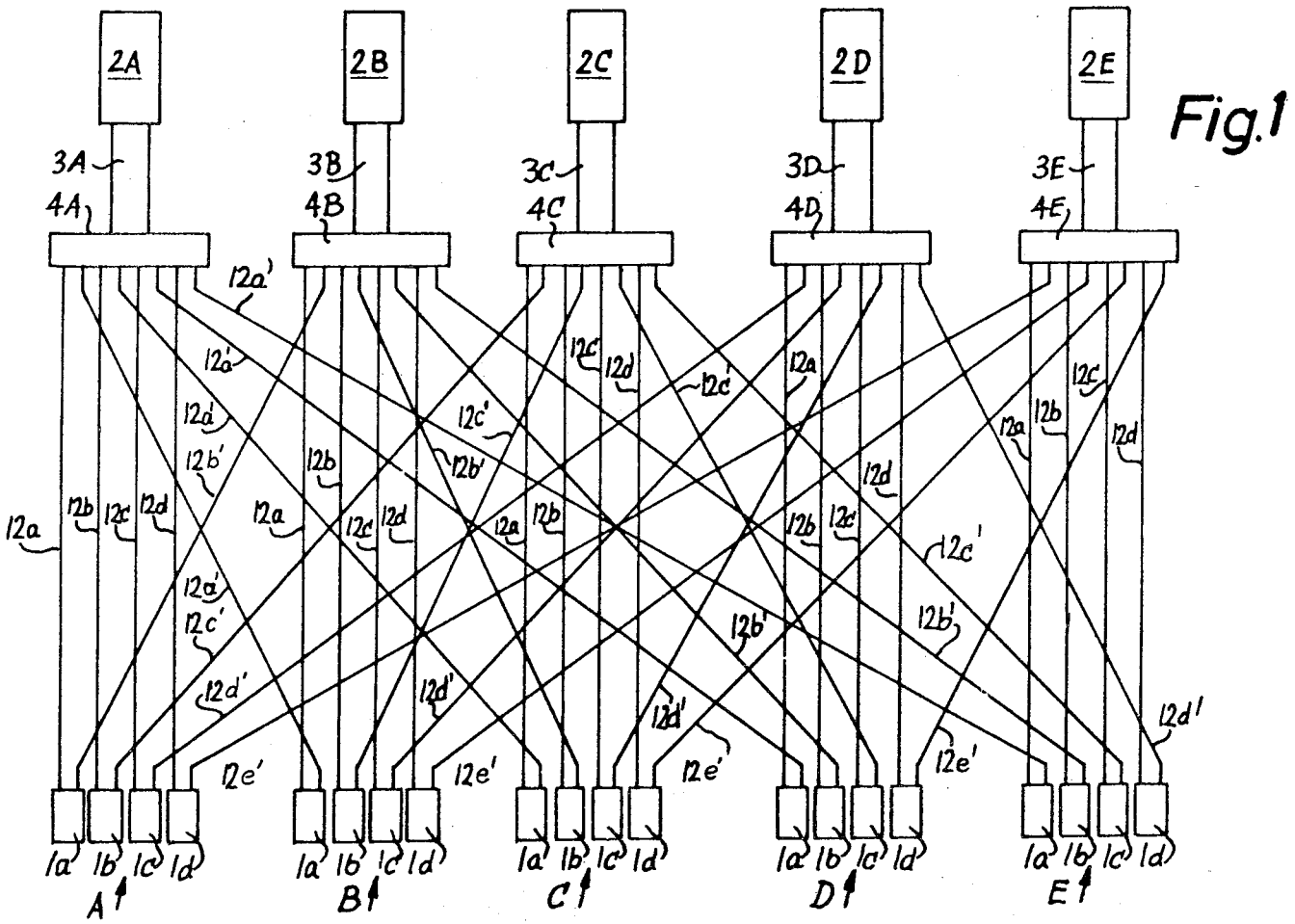
FIG. 1 is a schematic plan view of a battery of production lines each of which includes a filter tipping machine and an apparatus for delivery of filter rod sections to the magazine of the filter tipping machine.

FIG. 1 shows schematically a plant which produces filter cigarettes and includes five groups A, B, C, D and E of four filter tipping machines 1*a*, 1*b*, 1*c*, 1*d* each, i.e., a total of twenty filter tipping machines. The plant comprises five filter rod making machines or filter makers 2A, 2B, 2C and 2E each of which can deliver filter rod sections of requisite length (e.g., six times unit length) to all four filter tipping machines 1*a*–1*d* of one of the groups A–E as well as to one selected filter tipping machine 1*a* or 1*b* or 1*c* or 1*d* of each other group. As shown in FIG. 1, the filter rod making machines 2A–2E respectively deliver filter rod sections to five discrete reservoir systems 3A, 3B, 3C, 3D and 3E, and these reservoir systems respectively deliver filter rod sections to five discrete pneumatic senders 4A, 4B, 4C, 4D and 4E. Each of the five senders 4A–4E has eight propelling units 9 (see FIGS. 2 and 3) which are connected with selected filter tipping machines by eight pneumatic conveyors including those denoted by reference characters 12*a*, 12*b*, 12*c*, 12*d* plus four additional pneumatic conveyors respectively denoted by the reference characters 12*a*', 12*b*', 12*c*', 12*d*' and 12*e*'. Thus, the first, third, fifth and seventh propelling units 9 of the first pneumatic sender 4A are respectively connected with the filter tipping machines 1*a*, 1*b*, 1*c*, 1*d* of the first group A by the four leftmost pneumtic conveyors 12*a*, 12*b*, 12*c* and 12*d*, and the second, fourth, sixth and eighth propelling units 9 of the pneumatic sender 4A are respectively connected with the filter tipping machine 1*a* of the group B, with the filter tipping machine 1*a* of the group C, with the filter tipping machine 1*a* of the group D and with the filter tipping machine 1*a* of the group E by the corresponding pneumatic conveyors 12*a*'. Analogously, the first, third, fifth and seventh propelling units 9 of the pneumatic sender 4B are connected with the machines 1*a*, 1*b*, 1*c*, 1*d* of the second group B by the second set of pneumatic conveyors 12*a*–12*d* (as viewed in a direction from the left of FIG. 1), and the second, fourth, sixth and eighth propelling units 9 of the sender 4B are connected with the filter tipping machines 1*a*, 1*b*, 1*b* and 1*b* of the groups A, C, D and E by the corresponding pneumatic conveyors 12*b*'. The first, third, fifth and seventh propelling units 9 of the pneumatic sender 4C are connected with the machines 1*a*–1*d* of the group C by the third set of pneumatic conveyors 12*a*–12*d*, and the second, fourth, sixth and eighth propelling units 9 of the sender 4C are respectively connected with the filter tipping machines 1*b*, 1*b*, 1*c* and 1*c* of the groups A, B, D and E by the corresponding pneumatic conveyors 12*c*'. The first, third, fifth and sevennth propelling units 9 of the sender 4D are connected with the machines 1*a*, 1*b*, 1*c*, 1*d* of the group D by the fourth set of pneumatic conveyors 1*a*–1*d*, and the second, fourth, sixth and eighth propelling units 9 of the sender 4D are respectively connected with the machines 1*c*, 1*c*, 1*c* and 1*d* of the groups A, B, C and E by the corresponding pneumatic conveyors 12*d*'. The first, third, fifth and seventh propelling units 9 of the pneumatic sender 4E are respectively connected with the machines 1*a*, 1*b*, 1*c*, 1*d* of the group E by the fifth set of pneumatic conveyors 1*a*–1*d*, and the second, fourth, sixth and eighth propelling units 9 of the sender 4E are respectively connected with the machines 1*d* of the groups A, B, C and D by the corresponding pneumatic conveyors 12*e*'.

The filter rod making machines 2A to 2E may be of the type known as KDF produced by Hauni-Werke Körber & Co. KG, Hamburg, Federal Republic Germany, the assignee of the present application. The reservoir systems 3A to 3E may be of the type known as RESY, also produced by the assignee of the present application, the pneumatic senders 4A to 4E may be of the type known as Filtromat, also produced by the assignee of the present application, and the filter tipping machines 1*a* to 1*d* in each of the five groups A to E may be of the type known as MAX or MAX S, also produced by the assignee of the present application.

Figure 2:
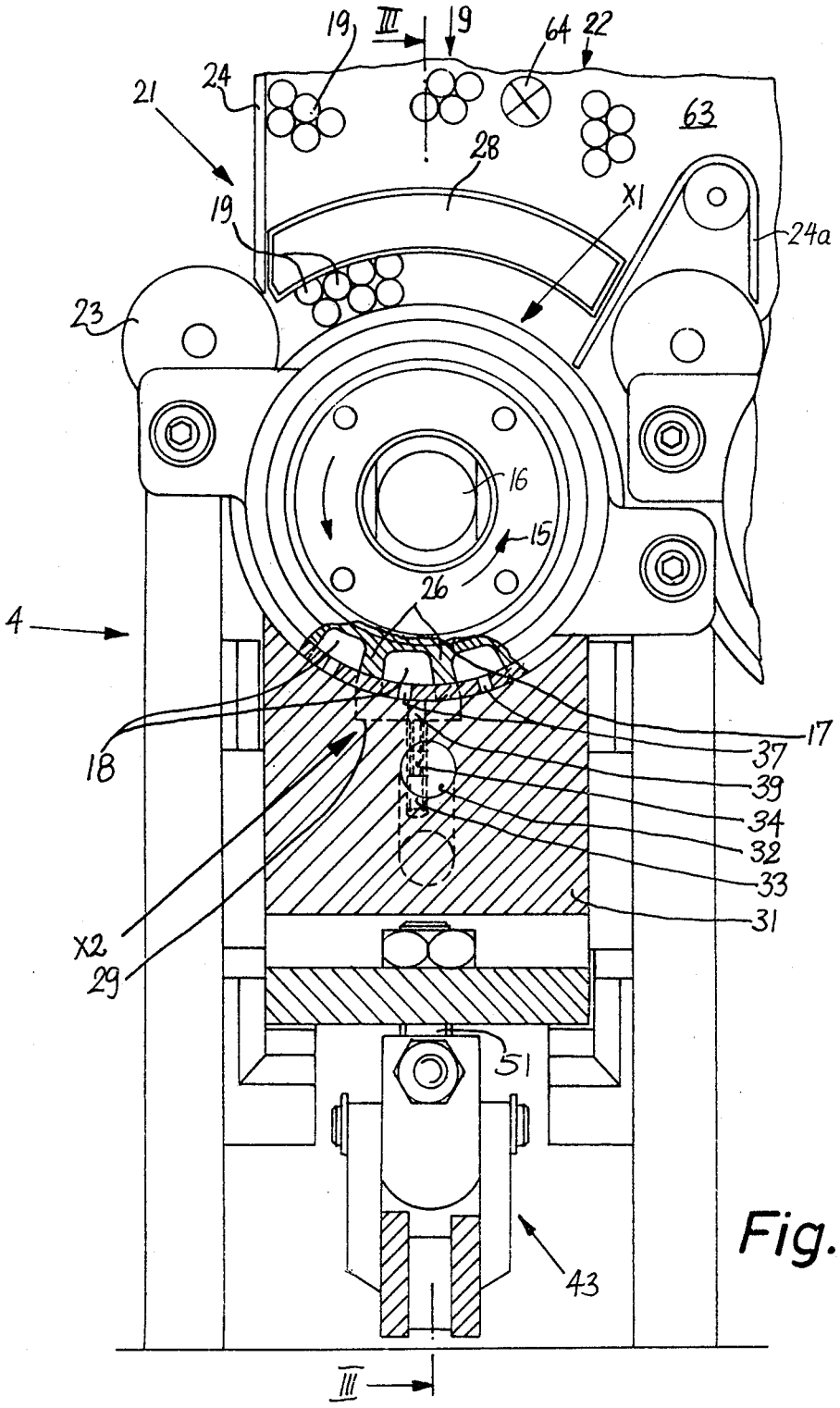
FIG. 2 is an enlarged transverse sectional view of a propelling unit for filter rod sections which is designed to deliver a file of filter rod sections to one of two pneumatic conveyors serving to transport filter rod sections to the magazine of a filter tipping machine, the section of FIG. 2 being taken in the direction of arrows as seen from the line II—II of FIG. 3.
Figure 3:
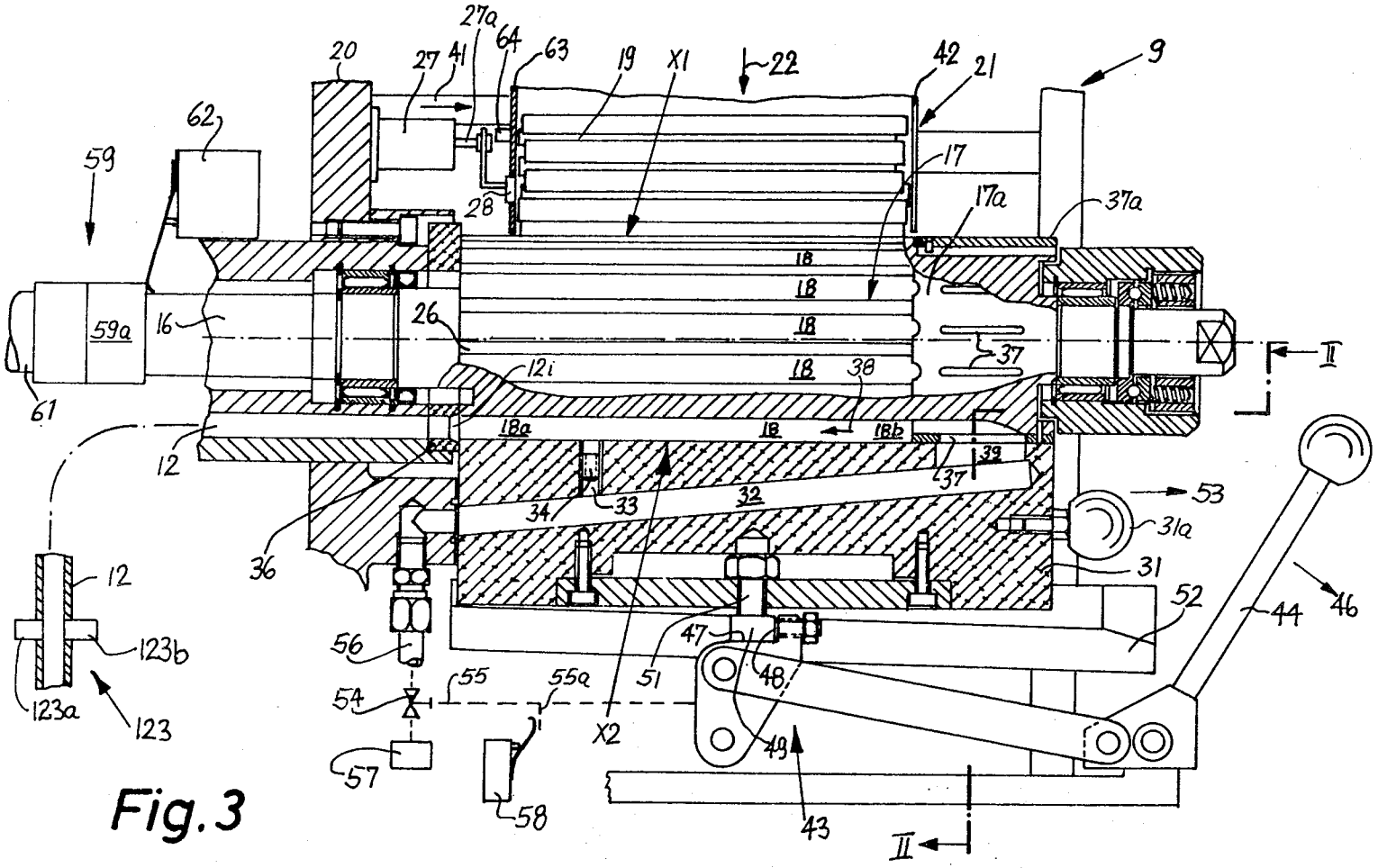
FIG. 3 is a central vertical sectional view of the propelling unit, substantially as seen in the direction of arrows from the line III—III of FIG. 2.

Each of the pneumatic senders 4A to 4E comprises eight discrete filter rod section propelling units 9 one of which is shown in detail in FIGS. 2 and 3. Furthermore, each of the filter tipping machines 1*a* to 1*d* in each of the five groups A to E is associated with two discrete filter rod receiving units 11 and 11' (see FIG. 4) which have means for accepting filter rod sections 19 from the respective propelling units 9 and further include means for feeding the thus accepted filter rod sections 19 into the magazine 66 of the respective filter tipping machine 1*a*, 1*b*, 1*c* or 1*d*. The arrangement may be such that the pneumatic conveyors 12–12*d* which receive filter rod sections 19 from the sender 4A deliver such sections to the receiving units 11 for the four filter tipping machines 1a–1d in the group A, and the leftmost pneumatic conveyors 12b', 12c', 12d', 12e' respectively deliver filter rod sections 19 from the corresponding propelling units 9 of the pneumatic senders 4B, 4C, 4D, 4E to the receiving units 11' for the machines 1a, 1b, 1c, 1d of the groups A. Analogously, the pneumatic conveyors 12a–12d which connect four propelling units 9 of the pneumatic sender 4B with the filter tipping machines of the group B deliver filter rod sections 19 to the receiving units 11 for the corresponding machines 1a, 1b, 1c, 1d in the group B, and the receiving units 11' for the machines 1a, 1b, 1c, 1d in the group B respectively receive filter rod sections 19 from the leftmost pneumatic conveyor 12a', from the second leftmost conveyor 12c', from the second leftmost conveyor 12d' and from the second leftmost conveyor 12e'. The receiving units 11 for the filter tipping machines 1a–1d in the group C receive filter rod sections 19 from the propelling units 9 of the sender 4C via corresponding set of pneumatic conveyors 12a–12d, and the receiving units 11' for the machines 1a, 1b, 1c, 1d in the group C respectively receive filter rod sections 19 from the second leftmost conveyor 12a', from the second leftmost conveyor 12b', from the third leftmost conveyor 12d' and from the third leftmost conveyor 12e'. The receiving units 11 for the filter tipping machines 1a–1d in the group D receive filter rod sections 19 from those propelling units 9 in the sender 4D which deliver such sections to the corresponding set of pneumatic conveyors 12a–12d, and the receiving units 11' for the machines 1a, 1b, 1c, 1d in the group D respectively receive filter rod sections 19 via the third leftmost conveyor 12a', the third leftmost conveyor 12b', the third leftmost conveyor 12c' and the rightmost conveyor 12e'. Finally, the receiving units 11 for the filter tipping machines 1a–1d in the group E receive filter rod sections 19 from those propelling units 9 in the sender 4E which supply filter rod sections to the corresponding set of pneumatic conveyors 12a–12d, and the receiving units 11' for the machines 1a, 1b, 1c, 1d in the group E respectively receive filter rod sections from the rightmost pneumatic conveyor 12a', rightmost pneumatic conveyor 12b', rightmost pneumatic conveyor 12c' and rightmost pneumatic conveyor 12d'.

One of the total of forty propelling units 9 is illustrated in FIGS. 2 and 3. The construction of these propelling units is similar to that of the propelling unit which is disclosed in commonly owned U.S. Pat. No. 3,827,757 granted Aug. 6, 1974 to Bob Heitmann et al. The disclosure of this U.S. patent is incorporated herein by reference.

FIGS. 2 and 3 show a propelling unit 9 which comprises a shaft 16 serving to transmit torque to a drum 17 having peripheral flutes 18 which are separated from each other by axially parallel ribs or webs 26. The shaft 16 drives the drum 17 at a constant speed and receives torque from a main shaft 61 through the medium of a safety clutch 59. The flutes 18 of the drum 17 receive filter rod sections 19 from a supply 22 which is stored in a source 21 here shown as a hopper 21 which receives filter rod sections from the outlet (not specifically shown) of the corresponding reservoir system 3A, 3B, 3C, 3D or 3E. The supply 22 contains parallel filter rod sections 19 and such filter rod sections are allowed to descend by gravity and to enter the oncoming flutes 18 in a region X1 substantially between the 10½ and 1½ o'clock positions of the drum 17, as viewed in FIG. 2. A roller 23 which is driven by the shaft 16 (or directly by the main shaft 61) in a manner not specifically shown in the drawing serves to agitate the adjacent portion of the supply 22 as well as to prevent jamming and damage to filter rod sections 19 in the zone where the flutes 18 move beyond the hopper 21. The drum 17 is driven to rotate in a counterclockwise direction (arrow 15), as viewed in FIG. 2.

The means for interrupting the transfer of filter rod sections 19 from the hopper 21 into the flutes 18 of the drum 17 comprises an elastic intercepting member 28 which is reciprocable in the hopper 21 in the axial direction of the filter rod sections 19 and is connected to the reciprocable armature 27a of an electromagnet 27. The latter is installed in the frame 20 of the respective pneumatic sender 4A, 4B, 4C, 4D or 4E and is energizable by an amplifier (FIG. 6) to thereby move its armature 27a in the direction of arrow 41 shown in FIG. 3, whereby the elastic member 28 (e.g., a flap made of rubber or the like) engages the adjacent end faces of one or more layers of filter rod sections 19 in the hopper 21 and urges the other end faces of such layer or layers against a rear end wall 42 of the hopper 21. The electromagnet 27 and the intercepting member 28 are adjacent to the front end wall 63 of the hopper 21. FIG. 2 shows that the intercepting member 28 can have an arcuate shape with a center of curvature on the axis of the shaft 16 and that the width of this intercepting member can be selected with a view to engage the end faces of two layers of filter rod sections 19 in the hopper 21. FIG. 3 shows the intercepting member 28 in the retracted or idle position in which the filter rod sections 19 are free to descend toward and into the flutes 18 of the rotating drum 17 while the flutes advance below the region X1. This region is bounded by a stationary wall 24 of the hopper 21 and by an endless belt 24a.

Those filter rod sections 19 which enter the oncoming flutes 18 of the drum 17 are transported from the region X1 to a region X2 where they leave the respective flutes to be introduced into the corresponding pneumatic conveyor (shown at 12 in FIG. 3). The illustrated pneumatic conveyor 12 can constitute any one of the five sets of pneumatic conveyors 12a–12d, any one of the four conveyors 12a', any one of the four conveyors 12b', any one of the four conveyors 12c', any one of the four conveyors 12d' or any one of the four conveyors 12e'.

It will be noted that each filter rod section 19 which is transferred from the region X1 to the region X2 moves sideways (i.e., transversely of its longitudinal axis) and that each filter rod section 19 whih has entered the region X2 and is propelled into and caused to move in the associated pneumatic conveyor (12 of FIG. 3) advances axially or lengthwise.

Prior to moving into register with the inlet 12i of the pneumatic conveyor 12 shown in FIG. 3, a filter rod section 19 and the corresponding flute 18 of the drum 17 move into register with a relatively wide cutout or recess 29 which is machined into the concave upper side or surface of a sealing shoe 31 and serves to admit a compressed gas (preferably air) from a source 57 of compressed gas, through a valve 54, a conduit 56, a sloping channel 32 in the shoe 31, a bore 33 which contains a preferably adjustable flow restrictor 34, and into the oncoming flute 18. The thus admitted compressed gas flows around the filter rod section 19 in the flute 18 which registers with the recess 29; therefore, the pressure of gas in the front portion 18a of such flute (the front portion 18a is then adjacent to a sealing disc 36 which engages the front end face of the sealing shoe 31 and has an aperture in register with the bore of the pneumatic conveyor 12) is the same as the pressure in the rear portion 18*b* of the same flute. This is due to the fact that the rear portion 18*b* communicates with the channel 32 of the sealing shoe 31 by way of a slot 37 which is machined into a cylinder 37*a* surrounding the smaller-diameter rear portion 17*a* of the drum 17. This ensures that the filter rod section 19 in a flute 18 which moves into register with the recess 29 is not abruptly propelled counter to the direction indicated by the arrow 38 when the bore 33 admits compressed gas into the front end portion 18*a* of such flute and especially when the flute 18 moves into register with the pneumatic conduit 12 wherein the pressure of gas exceeds atmospheric pressure (it being assumed that the filter rod sections 19 in the pneumatic conveyors are transported by compressed gas rather than under the action of suction). When a flute 18 which contains a filter rod section 19 moves into full register with the inlet 12*i* of the pneumatic conveyor 12, the rear end portion 18*b* of such flute receives highly compressed gas (normally air) through a discrete pipe or conduit 39 which causes highly compressed gas to enter the rear end portion 18*b* by way of the respective slot 37 so that the filter rod section 19 is abruptly propelled into the conveyor 12 before the angular movement of the drum 17 could cause a shearing of or other damage to the filter rod section. The arrow 38 indicates the direction of abrupt (practically instantaneous) expulsion of a filter rod section 19 from the corresponding flute 18 into the pneumatic conveyor 12. The connection between the outlet of the pipe 39 and the flute 18 which has moved beyond the position of register with the conveyor 12 is interrupted in automatic response to further rotation of the drum 17. In order to facilitate the entry of the leader of a filter rod section 19 into the pneumatic conveyor 12, the inlet 12*i* of this conveyor preferably flares outwardly and rearwardly, i.e., toward the front end face of the sealing shoe 31.

The same procedure is repeated as the drum 17 continues to rotate and moves successive filled flutes 18 into register first with the recess 29 of the sealing shoe 31 and thereupon with the inlet 12*i* of the pneumatic conveyor 12.

When the electromagnet 27 is deenergized, a spring (not shown) moves its armature 27*a* in the direction of the arrow 41 so that the intercepting member 28 engages one or more adjacent layers of filter rod sections 19 and cooperates with the rear end wall 42 to prevent further advancement of filter rod sections from the hopper 21 into the flutes 18 of the drum 17. The drum 17 merely removes those filter rod sections 19 which are located at a level below the lower edge portion of the intercepting member 28 when the electromagnet 27 is deenergized. The drum 17 can continue to rotate with the shaft 16 but the conveyor 12 ceases to receive filter rod sections 19 until after the electromagnet 27 is energized again to move the intercepting member 28 counter to the direction of the arrow 41 so that the lowermost layers of the supply 22 can descend into the region X1 and the flutes 18 again deliver discrete filter rod sections 19 into the region X2, i.e., toward the positions of alinement with the inlet 12*i* of the pneumatic conveyor 12.

The sealing block 31 is urged against the drum 17 by a bell crank lever 43 which is pivotable by a manually operable lever 44. When an attendant pivots the lever 44 in the direction of the arrow 46, the surfaces 47 and 48 of the bell crank lever 43 are moved away from the adjacent surfaces of an adjustable pressure transmitting member 51 which is a bolt or screw having a head 49 engageable by the surfaces 47 and 48. The sealing block 31 is then free to descend and to come to rest on a stationary support 52. The attendant is then in a position to withdraw the sealing block 31 in the direction of arrow 53 by engaging the handle 31*a*. Such removability of the sealing block 31 is of advantage because it allows for cleaning of the flutes 18 as well as for removal of filter rod sections 19 which happen to be squashed or otherwise damaged or totally destroyed during or preparatory to transfer from the flutes 18 into the pneumatic conveyor 12. Furthermore, such removability of the sealing block 31 renders it possible to allow for convenient cleaning of the channel 32, bore 33, flow restrictor 34 and/or that surface of the block 31 which is normally in sealing engagement with the lower portion of the drum 17.

When the lever 44 is pivoted in the direction of the arrow 46, the bell crank lever 43 automatically closes the valve 54 by way of an operative connection 55 which is indicated by broken lines. The valve 54 is installed in the conduit 56 and interrupts the flow of compressed gas from the source 57 to the channel 32 when the sealing block 31 is disengaged from the drum 17 and/or when the sealing block 31 is removed from the propelling unit 9 of FIGS. 2 and 3. The operative connection 55 has a trip 55*a* which actuates a signal generator 58 (e.g., a limit switch) when the valve 54 is closed so as to enable the part 58 to transmit a signal for the purposes to be described in connection with FIG. 6.

The aforementioned clutch 59 between the shafts 16 and 61 is disengaged when a squashed filter rod section 19 is caught between the sealing block 31 and the drum 17. Disengagement of the clutch 59 entails a movement of the clutch element 59*a* in a direction to the right, as viewed in FIG. 3, whereby the element 59*a* actuates a signal generator 62, e.g., a limit switch. The latter transmits a signal which denotes that the shaft 16 is idle, i.e., that the drum 17 does not transport filter rod sections 19 from the region X1 to the region X2. The shaft 61 receives torque from the prime mover of the respective pneumatic sender 4A, 4B, 4C, 4D or 4E.

The level of the upper surface of the supply 22 of filter rod sections 19 in the hopper 21 is monitored by a signal generating photoelectric detector 64 which may constitute a reflection type photocell. The detector 64 is mounted on the front end wall 63 of the hopper 21 and the light beam which issues from its light source can reach the associated transducer when the upper surface of the supply 22 sinks below a predetermined minimum acceptable level. In other words, the detector 64 transmits a signal whenever the light beam which is emitted by its light source is not reflected by the end face or faces of one or more filter rod sections 19 in the hopper 21.

Figure 4:
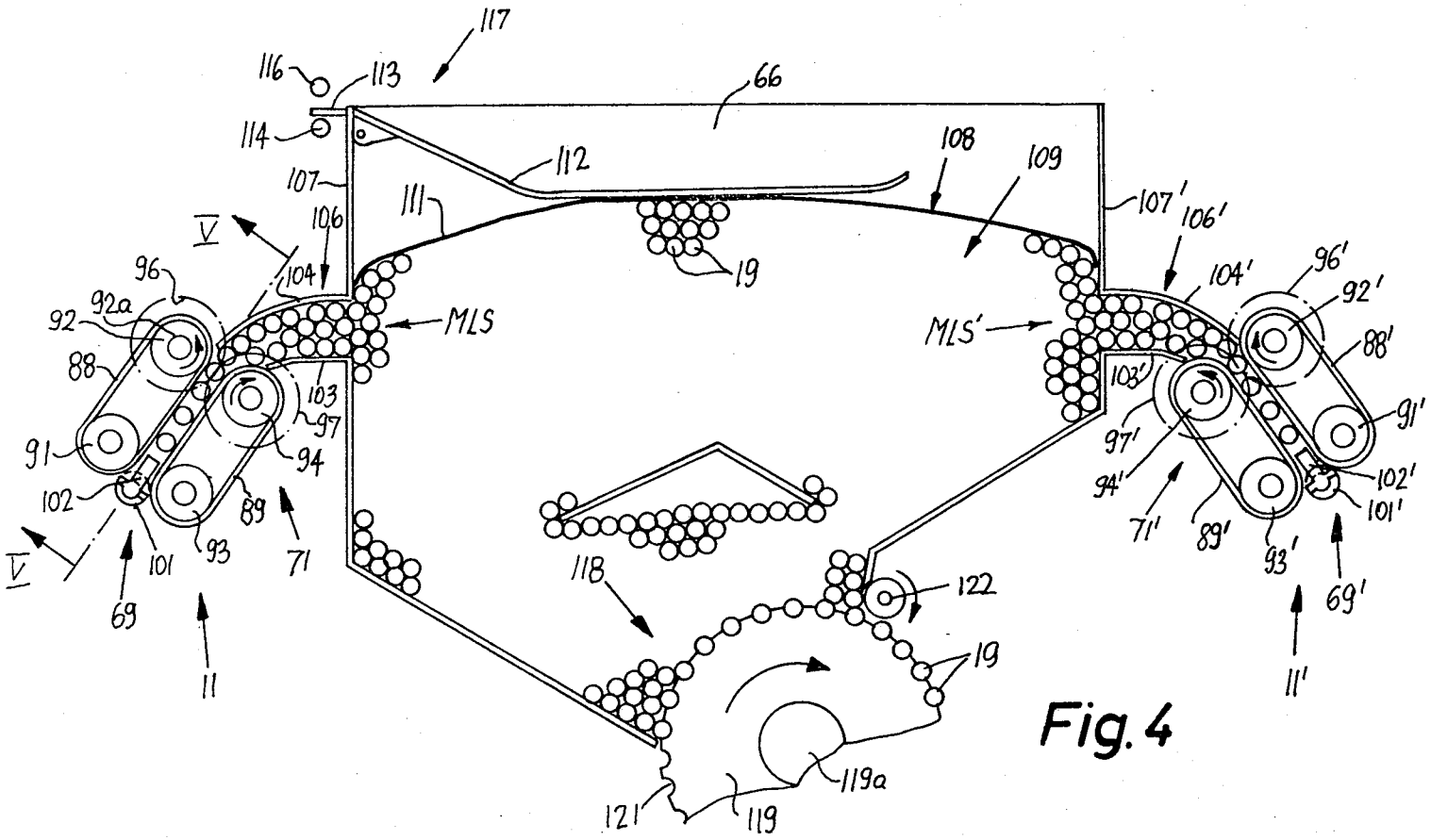
FIG. 4 is a schematic front elevational view of the magazine of one of the twenty filter tipping machines in the battery of production lines shown in FIG. 1.

FIG. 4 shows the magazine 66 of one of the twenty filter tipping machines (1*a*, 1*b*, 1*c* or 1*d* in the group A, B, C, D or E). Each magazine 66 can receive discrete multi-layer streams MLS and MLS′ of filter rod sections 19 from two receiving units 11 and 11′ which are disposed at the opposite sides of the magazine. Since the construction of the receiving unit 11 is identical with that of the receiving unit 11′, the component parts of the two receiving units are denoted by similar reference characters except that the characters denoting the parts of the receiving unit 11' are followed by primes.

Figure 5:
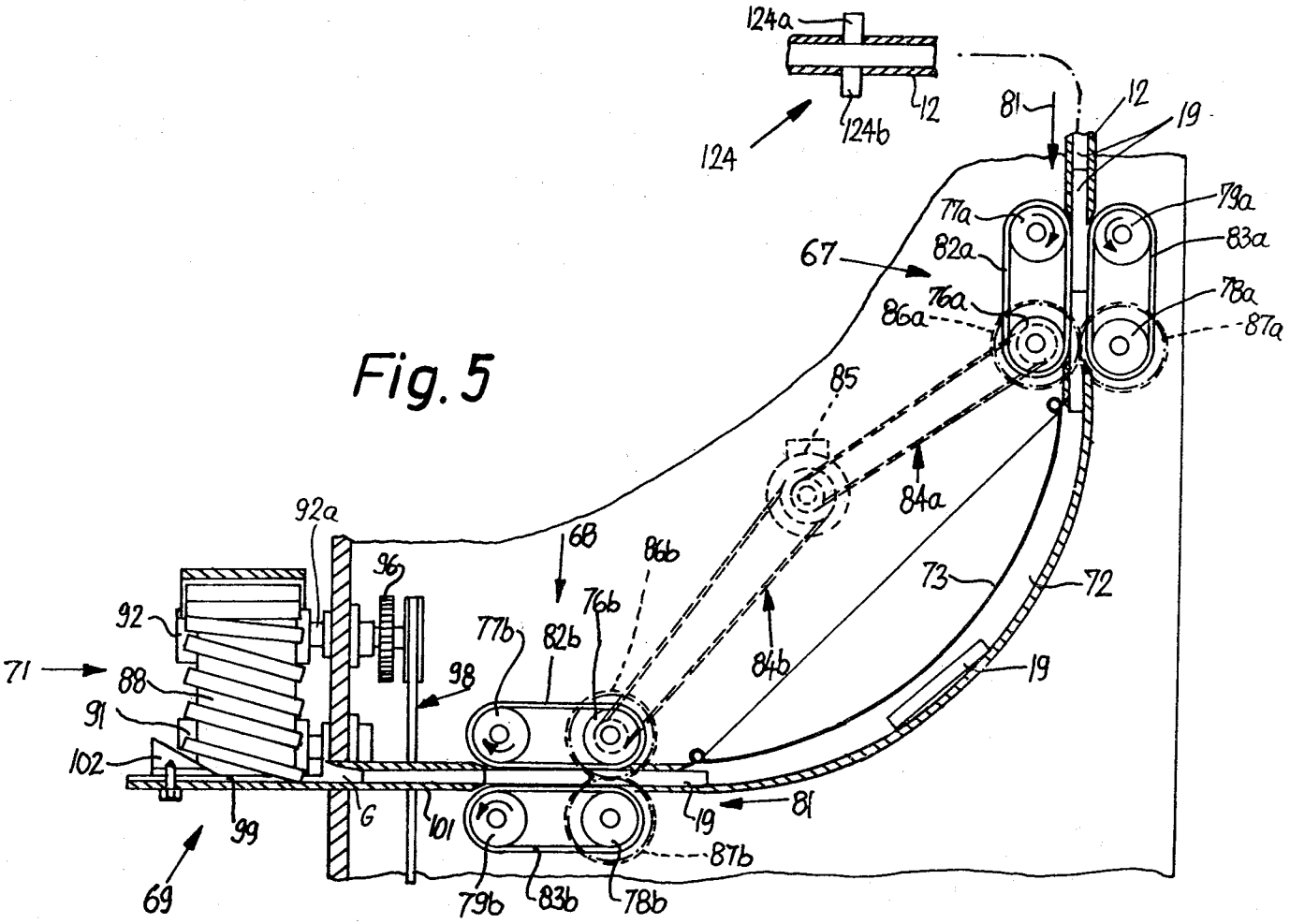
FIG. 5 is an enlarged sectional view as seen in the direction of arrows from the line V—V of FIG. 4 and shows a unit which receives filter rod sections from a pneumatic conveyor and converts the filter rod sections into a multi-layer stream prior to forcible introduction into the magazine of the filter tipping machine.

The receiving unit 11 comprises a speed uniformizing or equalizing accepting conveyor 67 (see FIG. 5) which serves to accept and advance filter rod sections 19 issuing from the outlet of the pneumatic conveyor 12 (it being assumed that the receiving unit 11 is disposed at the discharge end of the pneumatic conveyor whose inlet 12*i* is illustrated in the left-hand portion of FIG. 3). The accepting conveyor 67 is designed to advance at a predetermined speed successive filter rod sections 19 of the file of such sections issuing from the pneumatic conveyor 12. The thus accepted filter rod sections 19 of the file enter an accelerating device 68 which is shown in FIG. 5 and serves to increase the speed of successive foremost filter rod sections 19 so as to ensure that the sections which advance beyond the accelerating device 68 are separated from each other by gaps G of given width, namely, of a width which is sufficient to prevent a next-following section 19 from interfering with a change in the direction of movement of the preceding section 19. The accelerating device 68 of the receiving unit 11 is followed by a deflecting or reorienting device 69 which causes successive oncoming filter rod sections 19 to move sideways (the sections 19 advance by moving axially or lengthwise through the pneumatic conveyor 12, through the speed equalizing accepting conveyor 67, an arcuate U-shaped guide 72 between the accepting conveyor 67 and the accelerating device 68 and toward the deflecting device 69) toward and into the supply 109 of filter rod sections 19 in the magazine 66. The deflecting device 69 is followed by a feeding device 71 for forcible introduction of filter rod sections 19 (which move sideways) into the interior of the magazine 66 at a level below the upper surface 108 of the supply 109 therein.

The open side of the arcuate U-shaped guide 72 between the accepting conveyor 67 and the accelerating device 68 is overlapped by a flexible panel or lid 73 of springy sheet metal or the like. The guide 72 also constitutes a direction changing or reorienting device; however, whereas the deflecting device 69 changes the direction of movement of successive accelerated filter rod sections 19 from axial movement to sidewise or transverse movement, the guide 72 merely changes the direction of axial or lengthwise movement of the non-accelerated filter rod sections 19 through a given angle, e.g., through approximately 90 degrees so that the filter rod sections 19 which move downwardly on leaving the accepting conveyor 67 move horizontally during entry into the accelerating device 68. An advantage of the guide 72 and its cover 73 is that the direction of axial movement of successive filter rod sections 19 can be changed in a very small area and without defacing and/or otherwise damaging the filter rod sections.

The construction of the speed equalizing accepting conveyor 67 is practically identical with that of the accelerating device 68. The only difference is that the device 68 advances the oncoming filter rod sections 19 at a speed which is higher than the speed of lengthwise movement of filter rod sections 19 which leave the conveyor 67. The reference characters denoting the parts of the speed equalizing accepting conveyor 67 are followed by the letter a, and the reference characters which denote parts of the accelerating device 68 (such parts are identical with the corresponding parts of the conveyor 67) are followed by the letter b. As shown in FIG. 5, the accepting conveyor 67 comprises four pulleys 76*a*, 77*a*, 78*a* and 79*a*. The pulleys 76*a*, 77*a* are located at one side of the path of movement of filter rod sections 19 from the outlet of the pneumatic conveyor 12 toward the guide 72, and the pulleys 78*a*, 79*a* are located at the other side of such path. The direction in which successive filter rod sections 19 enter the conveyor 67 and thereupon the accelerating device 68 is indicated by the arrows 81. A first endless belt 82*a* is trained over the pulleys 76*a*, 77*a*, and a second endless belt 83*a* is trained over the pulleys 78*a*, 79*a*. The neighboring portions or reaches of the belts 82*a*, 83*a* travel downwardly, as viewed in FIG. 5, and the distance between such reaches at most equals the diameter of a filter rod section 19 so that a filter rod section which enters the space between these belts is compelled to advance at the exact speed of the belts on its way toward and into the guide 72. The belts 82*a*, 83*a* can accelerate or decelerate successive filter rod sections 19 (or selected filter rod sections), depending upon the speed at which the filter rod sections leave the outlet of the pneumatic conveyor 12. In order to ensure that the speed of the belt 82*a* invariably matches the speed of the belt 83*a*, the speed equalizing accepting conveyor 67 further comprises two mating gears 86*a*, 87*a* which are respectively coaxial with the pulleys 76*a*, 78*a* and have identical diameters as well as identical numbers of teeth. A prime mover 85 which is installed in, on or adjacent to the frame of the filter tipping machine including the magazine 66 of FIG. 5 drives the pulley 76*a* and the gear 86*a* through the medium of an endless belt 84*a* whereby the gear 86*a* drives the gear 87*a* and pulley 78*a*. The pulleys 76*a*, 78*a* respectively drive the belts 82*a*, 83*a* which, in turn, drive the pulleys 77*a*, 79*a*. It is clear that the pulleys 76*a*–79*a* can be replaced with sprocket wheels or gears if the belts 82*a*, 83*a* are replaced with chains or toothed belts.

The endless belt 84*b* which is driven by the prime mover 85 (e.g., a variable-speed electric motor) and drives the pulley 76*b* and gear 86*b* of the accelerating device 68 causes the belts 82*b* and 83*b* to travel at a speed which is higher than the speed of the belts 82*a*, 83*a*. This ensures that, if not separated ahead of the accelerating device 68, successive filter rod sections 19 are separated from each other by gaps G of requisite width not later than in the region between the accelerating device 68 and the deflecting device 69.

The deflecting device 69 of the receiving unit 11 cooperate with two endless belts 88 and 89 which are best shown in FIG. 4. The belts 88, 89 form part of the device 71 and serve to forcibly feed successive filter rod sections 19 into the magazine 66. The positions of the belts 88 and 89 are selected in such a way that they move successive filter rod sections 19 sideways, i.e., a single file of sections 19 which advance toward, through and beyond the accelerating device 68 is converted into at least one row of filter rod sections which move sideways upwardly toward and into the interior of the magazine 66. The belts 88 and 89 are respectively trained over pulleys 91, 92 and 93, 94 and the pulleys 92, 94 are respectively coaxial with mating gears 96, 97 which ensure that the speed of the belt 88 invariably matches the speed of the belt 89. The shaft 92*a* of the pulley 92 is driven by a variable-speed electric motor or another suitable prime mover whereby the shaft 92*a* drives the pulley 92 and gear 96 (see FIG. 5) and these parts respectively drive the belt 88 and the parts 94, 97, 89. The belts 88, 89 respectively drive the pulleys 91 and 93. The distance between the inner portions or reaches of the belts 88, 89 at most equals the diameter of a filter rod section 19 so that the filter rod sections which move sideways upwardly and away from the accelerating device 68 are positively entrained and forcibly introduced into the supply 109 which is confined in the interior of the magazine 66.

A plate-like or trough-shaped guide 99 of the deflecting device 69 is disposed between the accelerating device 68 and the lower end turns of the belts 88 and 89. The discharge end of the guide 99 carries or contains a wedge-like deflecting element 102 whose upwardly inclined surface lifts the leaders of successive filter rod sections 19 so that such leaders enter the space between the inner reaches of the belts 88, 89 and are caused to move upwardly as shown in the left-hand portion of FIG. 5. The reference character 101 denotes a tubular guide member which is interposed between the pulleys **77*b*, 79*b* of the accelerating device 68 and the guide 99 of the deflecting device 69. The motion transmitting connection between the aforementioned (non-illustrated) motor and the shaft 92*a* comprises an endless belt or chain transmission 98 shown in FIG. 5**.

The single row of filter rod sections 19 which reach the upper end turns the belts 88, 89 is converted into the multi-layer stream MLS which advances through a funnel 106 including stationary lower and upper arcuate walls 103, 104 and into the interior of the magazine 66. The walls 103, 104 are integral with or connected to the adjacent side wall 107 of the magazine 66; the side wall 107 has an opening of appropriate size and shape to allow for entry of the multi-layer stream MLS into the interior of the magazine, i.e., into the supply 109.

The operation of the receiving unit 11 is as follows

The pneumatic conveyor 12 delivers filter rod sections 19 to the speed equalizing accepting conveyor 67 wherein the sections are engaged by the inner reaches of the belts **82*a*, 83*a* so that the speed of each and every filter rod section advancing beyond the conveyor 67 (i.e., into the guide 72) matches a predetermined speed. The guide 72 directs successive filter rod sections 19 into the accelerating device 68 (the speed of successive filter rod sections which reach the belts 82*b*, 83*b* of the accelerating device 68 also matches a predetermined speed because the speed of all sections 19 leaving the conveyor 67 is identical and the friction between successive sections 19 and the surfaces of the guide 72 and/or cover 73 is constant). The belts 82*b* and 83*b* positively engage and propel successive filter rod sections 19 into the guide member 101 whereupon successive sections 19 advance in the trough-shaped guide 99 to reach the wedge-like deflecting element 102 which lifts the leading ends of such filter rod sections so that they can be engaged and entrained by the endless belts 88, 89 of the feeding device 71. The direction of movement of successive filter rod sections 19 is changed from axial to sidewise on entry between the inner reaches of the belts 88 and 89. The leader of an oncoming filter rod section 19 (namely, of a section which advances in the guide member 101 and along the rear portion of the trough-shaped guide 99) cannot interfere with conversion of lengthwise movement into sidewise movement of the preceding section 19 because the difference between the speeds of the belts 82*a*, 83*a* on the one hand and the speed of the belts 82*b*, 83*b* on the other hand suffices to entail the formation of gaps G of requisite width. The funnel 106 including the stationary walls 103, 104 converts the single row of ascending filter rod sections 19 into the multi-layer stream MLS successive increments of which are forced into the interior of the magazine 66 at a level below the upper surface 108 of the supply 109. The layer MLS is forced into the magazine 66 by the belts 88, 89, i.e., by the single row of filter rod sections 19 which are forcibly introduced into the lower portion of the funnel 106 including the walls 103, 104**.

The supply 109 of filter rod sections 19 in the magazine 66 is monitored by a sensor 112 which is pivotably mounted on the side wall 107 and has a projection 113 serving as a trip for a lower signal generator 114 or an upper signal generator 116. Each of these signal generators may constitute a proximity switch of any known design. The free end portion of the sensor 112 does not rest directly on the supply 109 but rather on a loosely mounted flexible cover 111 which reduces the likelihood of misalignment of filter rod sections 19 forming the supply 109 in the magazine 66. The sensor 112, its projection or trip 113 and the signal generators 114, 116 together constitute a monitoring device 117 which generates signals when the upper surface 108 of the supply 109 rises above a predetermined upper level or drops below a predetermined lower level.

The bottom portion of the magazine 66 is formed with an outlet opening 118 which receives a portion of a fluted withdrawing or evacuating drum 119 mounted on a driven shaft **119*a*. The axially parallel peripheral flutes of the drum 119 are shown at 121; these flutes remove filter rod sections 19 from the interior of the magazine 66 for introduction into the filter tipping machine 1*a*, 1*b*, 1*c* or 1*d* proper. A filter tipping machine which can be used to process the filter rod sections 19 and can be equipped with the magazine 66 of FIG. 4 is disclosed, for example, in commonly owned U.S. Pat. No. 4,237,907 granted Dec. 9, 1980 to Pawelko et al. for "Apparatus for convoluting adhesive-coated uniting bands around groups of rod-shaped articles in filter tipping and like machines". The drum 119 may constitute a so-called severing conveyor which transports filter rod sections 19 sideways past two axially and circumferentially staggered rotary disc-shaped knives (not shown) serving to subdivide each filter rod section 19** into three filter plugs of double unit length. Such filter plugs are normally employed for the making of filter cigarettes of double unit length, e.g., in a manner as disclosed in the aforementioned U.S. Pat. No. 4,237,907.

An agitating roller 122 is adjacent to one side of the outlet opening 118 to prevent jamming of filter rod sections 19 in the region where successive freshly filled flutes 121 advance beyond the outlet opening. The direction of rotation of the roller 122 is the same as that of the drum 119. The right-hand side wall 107' of the magazine 66 shown in FIG. 4 is shortened so as to enable a portion of the roller 122 to agitate the contents of the magazine in the region immediately adjacent to the right-hand side of the outlet opening 118. The receiving unit 11' of FIG. 4 is mirror symmetrical to but otherwise identical with the receiving unit 11.

Figure 6:
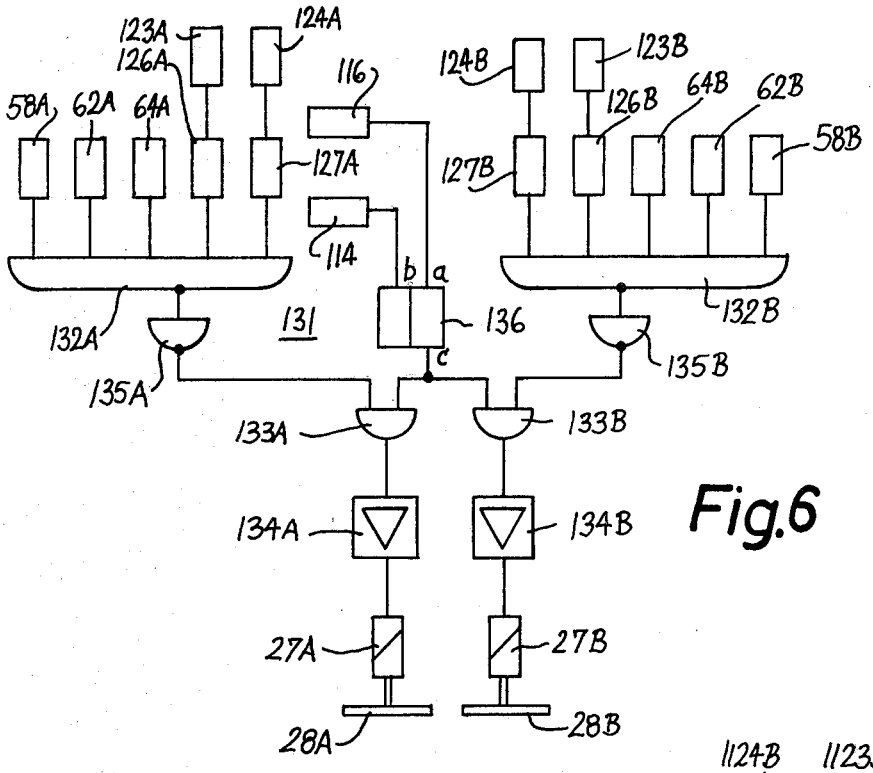
FIG. 6 is a circuit diagram of a control unit which regulates the delivery of filter rod sections to opposite sides of the supply of filter rod sections in the magazine of FIG. 4.

FIG. 5 shows that the outlet portion of the pneumatic conveyor 12 is equipped with a signal generator 124 which is located downstream of a similar signal generator 123 (see the left-hand portion of FIG. 3). The signal generator 123 includes a light source **123*a* and a photoelectronic transducer 123*b* which generates signals in response to detection of light rays emitted by the source 123*a*. Analogously, the signal generator 124 comprises a light source 124*a* and a transducer 124*b*. The signal generator 123 is activated whenever the corresponding propelling unit 9 is to deliver filter rod sections 19. For example, the signal generator 123 can be activated simultaneously with energization of the electromagnet 27, i.e., when the electromagnet 27 is caused to retract the elastic intercepting member 28 so that filter rod sections 19 of the supply 22 can descend into the region Xl. The means for energizing the electromagnet 27 and for activating the signal generator 123 can be actuated by hand or in automatic response to a request signal. The connection between the energizing means and the signal generator 123 may comprise a simple AND gate. FIG. 6 shows that an electromagnet 27A corresponding to the electromagnet 27 can be energized by an amplifier 134A**.

As shown in FIG. 6, the signal generators 123, 124 of each pneumatic conveyor are connected in series with discrete time delay units 126 and 127, e.g., time delay units of the type known as Sigmatronic and produced by the firm BBC. The time delay unit 126 transmits a signal in response to failure of the signal generator 123 to detect any filter rod sections 19 for a given (e.g., variable) interval of time, i.e., in response to failure of the propelling unit 9 of FIGS. 2 and 3 to deliver filter rod sections 19 into and beyond the inlet 12*i* of the pneumatic conveyor 12. On the other hand, the time delay unit 127 transmits a signal in response to continuous (uninterrupted) detection of filter rod sections 19 by the signal generator 124 for a given interval of time.

The manner in which the delivery of filter rod sections 19 from two discrete propelling units 9 (for example, from the leftmost propelling unit of the sender 4A shown in FIG. 1, via leftmost pneumatic conveyor 12*a* and to the left-hand receiving unit 11 of the magazine 66 in the leftmost filter tipping machine 1*a* of the group A as well as from the second leftmost propelling unit 9 of the sender 4B of FIG. 1, via leftmost pneumatic conveyor 12*b'* and the right-hand receiving unit 11' of the filter tipping machine 1*a* in the unit A of FIG. 1) to the corresponding receiving units of the associated filter tipping machine is illustrated in FIG. 6. The reference character 131 denotes the entire control unit. The structure of FIG. 1 comprises a total of twenty control units 131, one for each filter tipping machine. Those elements of the control unit 131 of FIG. 6 which serve to regulate the delivery of filter rod sections 19 to the receiving unit 11 of the leftmost machine 1*a* of FIG. 1 are identical with the elements which serve to regulate the delivery of filter rod sections to the receiving unit 11' of the same filter tipping machine. For the sake of convenient differentiation, the elements in the left-hand half of the control unit 131 are denoted by reference numerals each followed by the letter "A", and the elements in the right-hand half of the control unit 131 are denoted by identical reference numerals each of which is followed by the letter "B". Thus, the parts 58A, 62A, etc. regulate the delivery of filter rod sections 19 from the sender 4A to the receiving unit 11 of the leftmost filter tipping machine 1*a*, and the parts 58B, 62B, etc. regulate the delivery of filter rod sections 19 from the sender 4B to the receiving unit 11' of the same machine 1*a*. The outputs of the signal generators 58A, 62A, 64A are directly connected with the corresponding inputs of an OR gate 132A, and the outputs of the signal generators 123A, 124A are indirectly connected with the corresponding inputs of the OR gate 132A by way of the associated time delay units 126A, 127A. A second OR gate 132B is directly connected with the outputs of the signal generators 56B, 62B, 64B and is indirectly connected with the outputs of the signal generators 123B, 124B (by way of the time delay units 126B, 127B).

The outputs of the OR gates 132A, 132B are respectively connected with the inputs of inverters 135A, 135B whose outputs are connected with the corresponding inputs of AND gates 133A, 133B. The other inputs of the AND gates 133A, 133B are connected with the output c of a storage whose setting input a is connected with the signal generator 116 and whose resetting or erasing input b is connected with the signal generator 114. The signal generators 114, 116 form part of the monitoring device 117 which is shown in FIG. 4. One such monitoring device is provided for each magazine 66, i.e., for each of the twenty filter tipping machine. The outputs of the AND gates 133A, 133B are respectively connected with the electromagnets 27A, 27B by way of amplifiers 134A, 134B. The armatures of the electromagnets 27A, 27B are connected with the respective intercepting members 28A, 28B.

The following description of operation of the control unit 131 of FIG. 6 applies for the delivery of filter rod sections 19 to the leftmost filter tipping machine 1*a* of FIG. 1. However, the operation of the remaining nineteen control units is the same except that such remaining control units regulate the delivery of filter rod sections to the receiving units 11, 11' of the corresponding other filter tipping machines including the machines 1*b*–1*d* of the group A and the machines 1*a*–1*d* of each of the groups B–E.

It is assumed that the two propelling units 9 (in the senders 4A and 4B) which deliver filter rod sections 19 to the receiving units 11, 11' of the leftmost machine 1*a* of the group A are operative as well as that the filter rod making machines 2A and 2B of FIG. 1 turn out filter rod sections 19. If the supply 109 of filter rod sections 19 in the magazine 66 of the leftmost filter tipping machine 1*a* of FIG. 1 (hereinafter simply called machine 1*a*) decreases so that its upper surface 108 descends to a level at which the signal generator 116 is actuated by the trip 113 of the sensor 112 and the trip 113 causes the signal generator 116 to transmit a signal to the setting input a of the storage 136, the output c of the storage 136 continuously transmits a signal to the corresponding inputs of the AND gates 133A and 133B. The outputs of the inverters 135A, 135B transmit signals to the other inputs of the AND gates 133A, 133B so that the outputs of the gates 133A, 133B transmit signals to the amplifiers 134A, 134B which energize the respective electromagnets 27A, 27B so that the intercepting members 28A, 28B are held in retracted positions and the two propelling units 9 receive filter rod sections 19 from the discrete sources (see the hopper 21 of FIG. 2) of the corresponding pneumatic senders 4A and 4B. This means that the pneumatic conveyors 12*a* and 12*a'* deliver filter rod sections 19 to the associated receiving units 11, 11' of the filter tipping machine 1*a*. The receiving units 11 and 11' form two multi-layer streams MLS and MLS' which are forcibly fed into the supply 109 in the magazine 66 of the machine 1*a*. As shown in FIG. 4, the streams MLS and MLS' enter the supply 109 from the opposite sides of the magazine 66. Consequently, the supply 109 is replenished and its upper surface 108 continues to rise until the sensor 112 completes an angular movement which suffices to cause its trip 113 to actuate the lower signal generator 114. The latter transmits a signal to the resetting input b of the storage 136 so that the signal at the output c of the storage 136 disappears and the electromagnets 27A and 27B are deenergized in view of the absence of signals at one input each of the two AND gates 133A, 133B. The intercepting members 28A and 28B engage the adjacent filter rod sections 19 and interrupt the delivery of such filter rod sections into the regions X2 of the respective propelling units 9, i..e, the pneumatic conveyors 12*a* and 12*a*′ cease to deliver filter rod sections to the receiving units 11 and 11′ of the filter tipping machine 1*a*. The same procedure is repeated again and again, i.e., the upper surface 108 of the supply 109 in the magazine 66 rises and falls to the extent which is determined by the configuration of the sensor 112 and the positions of signal generators 114, 116 relative to the trip 113.

However, if one of the other signal generators (58A, 62A, 64A, 123A, 124A or 58B, 62B, 64B, 123B, 124B) transmits a signal, either directly or by way of the corresponding time delay unit 126A, 127A, 126B or 127B, for example, because the attendant has removed the sealing shoe 31 from the corresponding propelling unit 9 (signal generator 58A or 58B), because the clutch 59 is disengaged due to excessive resistance of the shaft 16 to rotation with the main shaft 61 (signal generator 62A or 62B), because the supply 22 of filter rod sections 19 in the corresponding hopper 21 has descended below a minimum permissible level (signal generator 64A or 64B), because the one or the other propelling unit 9 fails to deliver filter rod sections 19 into the inlet of the respective pneumatic conveyor 12*a* or 12*a*′ (signal generator 123A or 123B) or because the one or the other pneumatic conveyor 12*a* or 12*a*′ accumulates filter rod sections 19 upstream of the respective receiving unit 11 or 11′ (signal generator 124A or 124B), the aforementioned regular raising and lowering of the upper surface 108 of the supply 109 in the magazine 66 of the machine 1*a* is interrupted. The signal from one of the just enumerated signal generators (other than the signal generator 114 or 116) is applied to the corresponding input of the OR gate 132A or 132B which transmits a signal to the input of the associated inverter 135A or 135B which ceases to transmit a signal to the corresponding input of the AND gate 133A or 133B so that the corresponding electromagnet 27A or 27B is deenergized and the intercepting member 28A or 28B assumes its operative position with the result that the corresponding propelling unit 9 ceases to deliver filter rod sections 19 to the associated receiving unit 11 or 11′. Under such circumstances (and assuming that the electromagnet 27A is deenergized while the electromagnet 27B remains energized, or vice versa), the magazine 66 receives a single multi-layer stream MLS or MLS′, depending upon whether the unit 11 or 11′ ceases to receive filter rod sections from the associated pneumatic conveyor 12*a* or 12*a*′. This normally suffices to maintain the filter tipping machine 1*a* in operation for an extended period of time in spite of the fact that the magazine 66 of such machine receives filter rod sections 19 by way of a single pneumatic conveyor 12*a* or 12*a*′. This holds especially true if the activation of one of the signal generators 58A, 62A, 123A, 124A, 58B, 62B, 64B, 123B or 124B entails the generation of a visible or audible signal which enables an attendant to immediately note the malfunctioning of one half of the means for supplying filter rod sections 19 to the magazine 66 so that the attendant can reduce the speed of the filter tipping machine 1*a*, for example, in such a way that the requirements of the filter tipping machine are met by the pneumatic conveyor 12*a* or 12*a*′.

Figure 7:
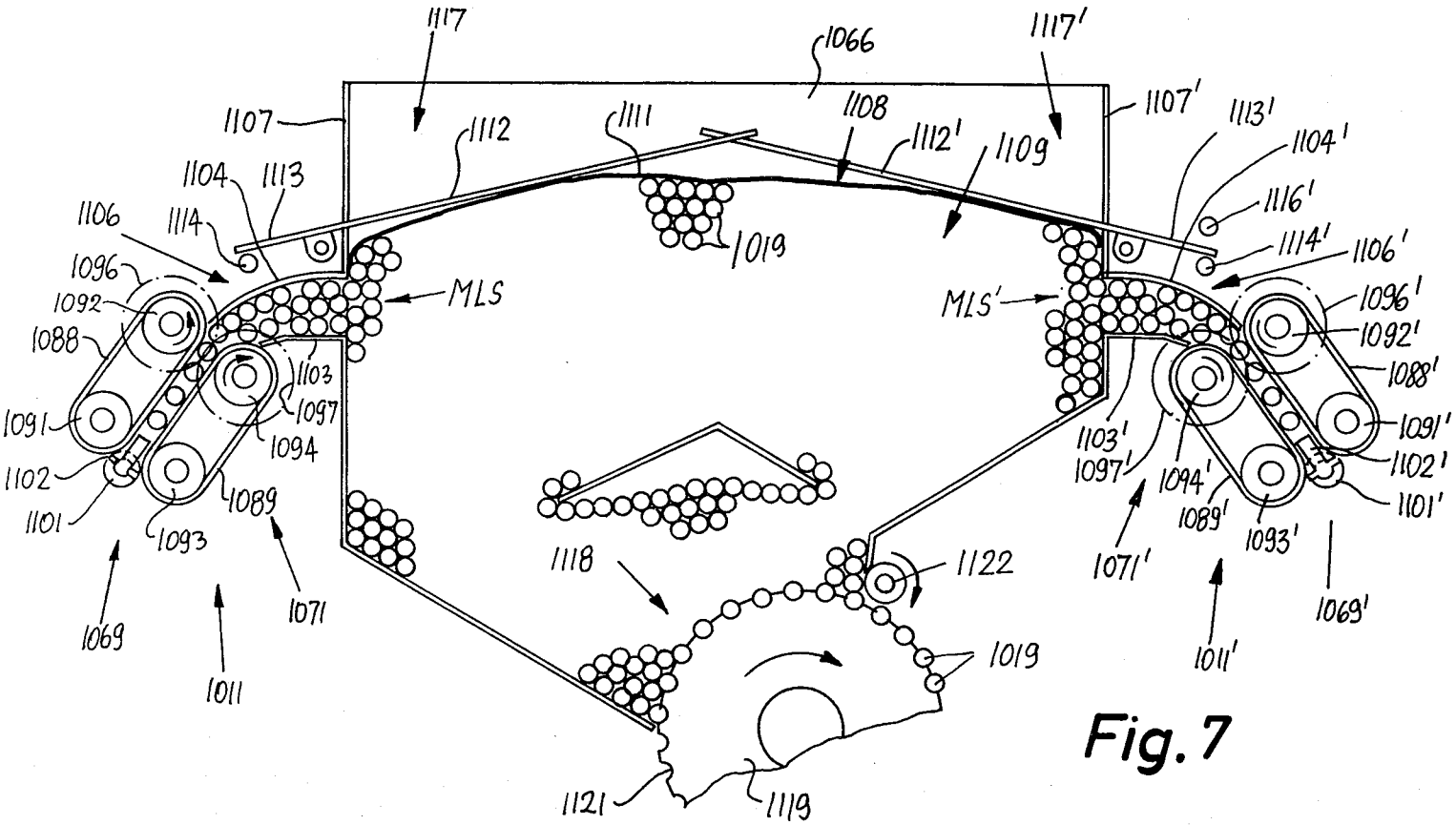
FIG. 7 is a schematic front elevational view of a modifid magazine.

FIG. 7 illustrates a portion of a magazine 1066 and the associated receiving units 10011 and 10011′. All such parts of the structure of FIG. 7 which are identical with or clearly analogous to the corresponding parts of the structure shown in FIG. 4 are denoted by similar reference characters plus 1000 and are not described again. The main difference between the structures of FIGS. 4 and 7 is that fluctuations of the supply 1109 of filter rod sections 1019 in the magazine 1066 are monitored by two discrete monitoring devices 1117 and 1117′ having sensors 1112, 1112′ with trips 1113, 1113′, a single signal generator 1114 cooperating with the sensor 1113, and two signal generators 1114′, 1116′ cooperating with the trip 1113′. The tips of the sensors 1112, 1112′ cross each other in space in the region above the median portion of the supply 1109 in the magazine 1066. The sensors 1112, 1112′ are respectively pivoted to the side walls 1107 and 1107′ of the magazine 1066. Each of the two sensors 1112, 1112′ may comprise a number of parallel prongs which extend through suitably configurated slots in the corresponding side walls 1107, 1107′ and each prong of the sensor 1112 extends into the space between the neighboring prongs of the sensor 1112′, and vice versa.

Figure 8:
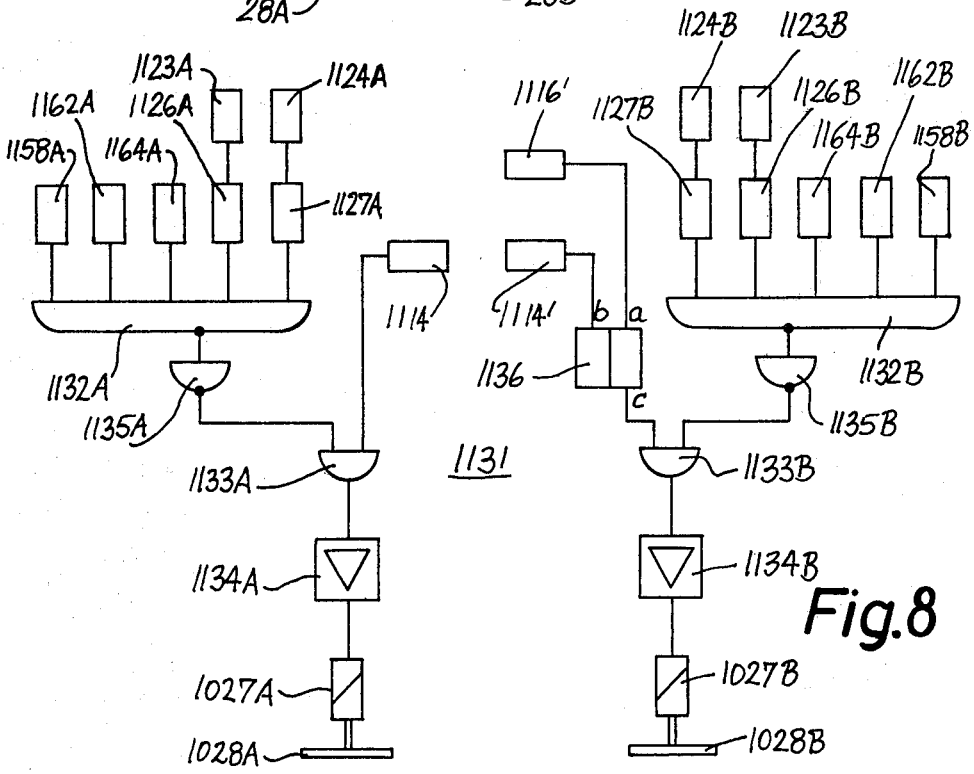
FIG. 8 is a circuit diagram of a control unit which regulates the delivery of filter rod sections to opposite sides of the supply of filter rod sections in the magazine of FIG. 7.

The control unit 1131 for a filter tipping machine which embodies the structure of FIG. 7 is shown in FIG. 8. All such components of the control unit 1131 which are identical with or clearly analogous to corresponding components of the control unit 131 of FIG. 6 are denoted by similar reference characters plus 1000. The main difference between the control units 131 and 1131 is that the signal generator 1114 transmits signals directly to the right-hand input of the AND gate 1133A, whereas the signal generators 1116′, 1114′ respectively transmit signals to the inputs a and b of the storage 1136. The output c of the storage 1136 is connected only with the left-hand input of the AND gate 1133B.

The signal generator 1114 is mounted in such a way that it transmits a signal to the AND gate 1133A when it is not actuated by the trip 1113 of the respective sensor 1112. For example, the signal generator 1114 can constitute a reflection type photocell. Consequently, the magazine 1066 of FIG. 7 ceases to receive the stream MLS from the left-hand unit 1011 only when the upper surface 1108 of the supply 1109 in the magazine 1066 rises above a predetermined maximum permissible level. In all other instances (i.e., when the trip 1113 of the sensor 1112 does not actuate the signal generator 1114), the magazine 1066 receives filter rod sections 1019 from the unit 1011 of FIG. 7.

The unit 1011′ of FIG. 7 begins to deliver a multi-layer stream MLS′ into the right-hand portion of the supply 1109 in the magazine 1066 only when the upper surface 1108 of the supply 1109 in the magazine 1066 has descended to such an extent that the trip 1113′ of the sensor 1112′ actuates the signal generator 1116′. The delivery of filter rod sections 1019 which form the multi-layer stream MLS′ of FIG. 7 is interrupted when the trip 1113′ of the sensor 1112′ actuates the signal generator 1114′. The arrangement is preferably such that the height of the upper surface 1109 at which the trip 1113′ engages the signal generator 1114′ corresponds to the height at which the signal generator 1114 causes the unit 1011 to interrupt the delivery of the multi-layer stream MLS into the left-hand portion of the supply 1108 shown in FIG. 7. This ensures uniform or symmetrical filling of both halves of the magazine 1066 with filter rod sections 1019.

It is already known to supply filter rod sections to a filter processing machine by way of two discrete pneumatic conveyor pipes. Such machines are used for the making of so-called multiplex filters wherein each filter consists of two or more plugs which are surrounded by a common wrapper. The composition of each multiplex filter is such that a single pneumatic conveyor would be incapable of furnishing requisite quantities of multiplex filters per unit of time. In other words, the capacity of such machines would be unduly reduced by the provision of a single conveyor which is incapable of satisfying the needs of the machine when the latter is operated at normal speed. Otherwise stated, the provision of a dual pneumatic conveyor system is attributable to the limited capacity of each pneumatic conveyor, i.e., to the inability of a single conveyor to deliver multiplex filter rod sections at the rate at which the machine processes the sections by uniting them with plain cigarettes or the like. Moreover, the two pneumatic conveyors which deliver multiplex filter rod sections to a machine of the just outlined character discharge into a common receiving unit which forms a single stream of filter rod sections for admission into the magazine. Thus, the likelihood of damage to the filter rod sections is even higher than in an apparatus which employs a single pneumatic conveyor pipe because the multiplex filter rod sections are likely to be damaged or defaced during conversion of two streams into a single stream and also during introduction of the single stream into the magazine of the processing machine.

The apparatus of the present invention is not designed for the express purpose of increasing the rate of delivery of filter rod sections to each of the processing machines 1*a*–1*d* in each of the units A–E. The improved apparatus ensures that each and every processing machine 1*a*, 1*b*, 1*c* or 1*d* can be operated without any interruptions even if one of the corresponding pneumatic conveyors fails to supply filter rod sections owing to malfunctioning of a maker (2A, 2B, 2C, 2D or 2E), owing to malfunctioning of a reservoir system (3A, 3B, 3C, 3D or 3E), owing to malfunctioning of a pneumatic sender (4A, 4B, 4C, 4D or 4E), owing to clogging of one of the two pneumatic conveyors which serve for delivery of filter rod sections to a given processing machine 1*a*, 1*b*, 1*c* or 1*d*, or as a result of malfunctioning of one of the two receiving units 11, 11' or 1011, 1011' which can be used to transfer filter rod sections 19 or 1019 from the respective pneumatic conveyors into the corresponding portions of the associated magazine 66 or 1066. Thus, whereas the malfunctioning of the single receiving unit which is used to transfer a single stream of multiplex filter rod sections into the magazine automatically entails a shutdown of the processing machine, malfunctioning of one of the receiving units 11, 11' or 1011, 1011' does not necessitate a shutdown of the corresponding filter tipping machine. It might be necessary to reduce the speed of the machine which receives filter rod sections from the improved replenishing apparatus, especially if the breakdown of one of the two receiving units lasts for an extended period of time; however, the processing machine need not be arrested at all because the other receiving unit continues to transfer filter rod sections at a rate which suffices to avoid a complete shutdown.

Another important advantage of the improved apparatus is that the stream of filter rod sections which is delivered by one of the receiving units cannot influence the admission of filter rod sections which form the other stream. This is due to the fact that each magazine is supplied with filter rod sections by two discrete receiving units and the filter rod sections which are delivered by the feeding means of the two discrete receiving units are not merged into a single stream. On the contrary, the two streams MLS and MLS' are admitted into the magazine at two opposite sides of the supply 109 or 1109 therein so that the refilling operation is more uniform (i.e., fluctuations of the upper surface 108 or 1108 are less pronounced). Moreover, the filter rod sections of the stream MLS or MLS' are less likely to deform or deface the previously admitted filter rod sections because the number of filter rod sections which are admitted by each of the two feeding means (such as 71 and 71') is or can be relatively small. This is important when the filter rod sections are sensitive (i.e., prone to deformation and/or other damage), for example, when the apparatus of the present invention serves to replenish the supplies of so-called NWA filters whose external surfaces are rather rough so that the neighboring filters are likely to become interlaced with each other, especially in response to the application of pronounced deforming stresses which could develop if each of the feeding means were to admit a large stream of filter rod sections per unit of time. Thus, the rate of transport of filter rod sections by each half of the improved apparatus, i.e., the rate of feeding of filter rod sections to each of the two sides of the magazine 66 or 1066) can be reduced to a fraction of the rate of delivery in conventional apparatus wherein a single pneumatic conveyor is used for each magazine. Alternatively or in addition to such mode of operation, the speed of operation of each half of the apparatus (or of each half of that portion of the apparatus which supplies filter rod sections to a given magazine 66 or 1066) can be reduced to a certain fraction of the maximum rate so that the apparatus is much less likely to become damaged or to require frequent attention and/or repair than if it were continuously operated at a maximum speed. For example, the improved apparatus can be operated at 70 percent of its maximum capacity, or each of its halves can be operated at a given capacity so that, and referring again to FIG. 4, the left-hand receiving unit 11 cannot satisfy more than 70 percent of the normal requirements of the processing machine which embodies the magazine 66, the same as the receiving unit 11'. This means that, if both receiving units deliver filter rod sections 19 at a maximum rate, the supply 109 in the magazine 66 rapidly increases. However, if the receiving units 11 and 11' are operated at less than a maximum rate, their combined output can match or closely approximate the requirements of the processing machine which embodies the magazine 66 so that the likelihood of malfunctioning of the two receiving units and/or of the associated propelling units 9 is much less pronounced than if each and every one of these units were always operated at a maximum speed. Furthermore, the provision of two receiving units and two propelling units for each magazine 66 renders it possible to intentionally arrest a propelling unit and the associated receiving unit for a given period of time, i.e., this allows for intermittent operation of receiving units and associated propelling units without entailing a reduction in the output of the corresponding processing machine 1*a*, 1*b*, 1*c* or 1*d*.

The provision of reservoir systems 3A–3E and pneumatic conveyors 12*a*–12*d* and 12*a'*–12*e'* renders it possible to dispense with so-called chargers or trays which are used in many presently known tobacco processing plants for delivery of filter rod sections, plain cigarettes or analogous rod-shaped articles to the magazines of processing machines. Many types of chargers must be manipulated by hand unless one wishes to resort to complex, bulky, expensive and sensitive automatic machinery for filling, transport and/or evacuation of the contents of chargers. Manual emptying of chargers (each of which normally contains several thousand rod-shaped articles) is tiresome because the magazine of a filter tipping machine is normally installed at a level well above the floor.

An additional important advantage of the improved apparatus is that each receiving unit can be started or arrested independently of the other receiving unit of a pair of associated receiving units. The same holds true for the propelling units 9. Thus, the control unit 131 or 1131 of FIG. 6 or 8 enables the corresponding receiving and propelling units to start or interrupt the delivery of filter rod sections 19 or 1019 independently of the other receiving or propelling unit or units, i.e., depending solely on the momentary requirements of the corresponding magazine 66 or 1066 and/or on the condition of the corresponding portion of the apparatus.

The provision of two monitoring devices 1117 and 1117' is especially advantageous when the operator wishes to ensure that the upper level 1108 of the supply 1109 does not fluctuate at all or fluctuates only negligibly in the event of temporary malfunction of the one or the other receiving unit and/or the associated propelling unit. Each of these monitoring devices controls one of the two propelling units which admit filter rod sections 1019 into the pneumatic conveyors (not shown) for delivery to the receiving units 1011 and 1011'. For example, the arrangement may be such that the receiving unit 1011 always meets approximately 70 percent of the requirements of the processing machine which embodies the magazine 1066 and the other receiving unit 1011' is operated only intermittently, always for relatively short intervals of time, to ensure that, on the average, the magazine 1066 is always filled to the desired level or that the quantity of filter rod sections 1019 therein does not fluctuate within a relatively wide range. Monitoring devices with pivotable sensors (1112, 1112') have been found to be especially suited for such mode of regulating the quantity of stored filter rod sections 1019.

Still another advantage of the improved apparatus is that the pneumatic conveyors which deliver filter rod sections to any given consuming machine 1*a*, 1*b*, 1*c* or 1*d* of the group A, B, C, D or E shown in FIG. 1 receive filter rod sections from discrete sources (21), i.e., from discrete pneumatic senders. This ensures that temporary stoppage of an entire sender 4A, 4B, 4C, 4D or 4E does not necessitate stoppage of any of the processing machines 1*a*–1*d* in any of the five groups A–E because each processing machine receives filter rod sections from two discrete senders. The same holds true for the reservoir systems 3A–3E and/or makers 2A–2E, i.e., malfunctioning of a maker or reservoir system need not entail stoppage of any processing machines because each of these machines receives or can receive filter rod sections from two discrete reservoir systems and two discrete makers. In addition, the attendants can intentionally arrest any one of the makers, reservoir systems and/or senders without affecting (or without greatly affecting) the combined output of the twenty processing machines because each processing machine receives or can receive filter rod sections from two discrete makers, reservoir systems and senders. Therefore, the attendants can inspect, repair or clean any selected maker, reservoir system or sender even if the shutdown is not attributable to an existing malfunction. All that might be necessary is to temporarily reduce the speed of one or more processing machines until the corresponding maker, reservoir system and/or sender is started again.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for replenishing the supply of filter rod sections in the magazine of a processing machine, such as a filter tipping machine, wherein the magazine comprises a plurality of spaced-apart portions and is normally filled to a predetermined level, comprising at least one source of filter rod sections; discrete first and second pneumatic conveyors for axial transport of filter rod sections, said conveyors having inlets adjacent to said source and outlets adjacent to said magazine; discrete first and second propelling units including means for delivering filter rod sections from said source into the inlets of the respective conveyors; and discrete first and second receiving units, each of said receiving units having means for accepting filter rod sections from the outlet of the respective pneumatic conveyor, deflecting means for converting the thus accepted filter rod sections into at least one row wherein the sections advance sideways, and means for feeding such row from the respective deflecting means into one of said spaced-apart portions of said magazine in a region below said predetermined level so that a row which is introduced into one portion of said magazine by one of said feeding means does not interfere with introduction of a row into another portion of said magazine by the other of said feeding means.

2. The apparatus of claim 1, wherein said feeding means comprise means for forcibly introducing said rows of filter rod sections into said magazine.

3. The apparatus of claim 1, wherein said magazine has first and second sides located opposite each other and the feeding means of said first and second receiving units respectively admit filter rod sections at the corresponding sides of said magazine.

4. The apparatus of claim 1, wherein said feeding means comprise pairs of endless flexible elements having portions spaced apart from each other by distances at most equal to the diameters of the filter rod sections and said deflecting means include means for delivering successive filter rod sections of said rows between said portions of the respective flexible elements for forcible introduction into said magazine.

5. The apparatus of claim 4, wherein said flexible elements are endless belts.

6. The apparatus of claim 1, further comprising means for starting and arresting said first and second propelling units independently of each other.

7. The apparatus of claim 6, wherein said starting and arresting means comprises means for monitoring the level of the supply of filter rod sections in said magazine.

8. The apparatus of claim 6, wherein said starting and arresting means comprises discrete first and second means for monitoring the level of the supply of filter rod sections in said magazine.

9. The apparatus of claim 8, wherein said first monitoring means includes means for generating first signals in response to descent of the upper surface of the supply of filter rod sections below a first predetermined value and said starting and arresting means includes means for starting said first propelling unit in response to said first signals, said second monitoring means including means for generating second signals in response to descent of the upper surface of the supply of filter rod sections in said magazine below a second predetermined value lower than said first value and said starting and arresting means including means for starting said second propelling unit in response to said second signals.

10. The apparatus of claim 8, wherein said first and second monitoring means respectively comprise first and second sensors movably mounted in said magazine and having portions resting by gravity on the supply of filter rod sections in the magazine.

11. The apparatus of claim 10, wherein said magazine has spaced apart first and second side walls disposed opposite each other and said first and second sensors are respectively pivoted to said first and second side walls.

12. The apparatus of claim 11, wherein each of said monitoring means further comprises at least one signal generator for each of said sensors and each of said sensors includes means for actuating the corresponding signal generator in a predetermined angular position of the respective sensor.

13. The apparatus of claim 1, further comprising first and second senders respectively including said first and second propelling units, said source including discrete first and second sources respectively forming part of said first and second senders and said propelling units being arranged to deliver filter rod sections from the respective discrete sources to the inlets of the associated pneumatic conveyors.

14. The apparatus of claim 13 for replenishing the supply of filter rod sections in the magazine of said first mentioned processing machine and in the magazine of at least one additional processing machine, wherein each of said senders further comprises at least one additional propelling unit and further comprising discrete first and second additional pneumatic conveyors for axial transport of filter rod sections, said additional conveyors having inlets arranged to receive filter rod sections from the respective additional propelling units and outlets adjacent to the magazine of said additional machine, and first and second additional receiving units having means for accepting filter rod sections from the outlets of the respective additional conveyors, deflecting means for converting the thus accepted filter rod sections into rows wherein the sections advance sideways, and means for feeding said last mentioned rows from the respective deflecting means into spaced-apart portions of the magazine of said additional machine.

15. The apparatus of claim 1, wherein each of said receiving units includes means for changing the direction of axial movement of filter rod sections in the region between the outlet of the respective pneumatic conveyor and the associated deflecting means.

* * * * *